US009465332B1

(12) United States Patent
Uehara

(10) Patent No.: US 9,465,332 B1
(45) Date of Patent: Oct. 11, 2016

(54) FIXING DEVICE AND IMAGE FORMING APPARATUS

(71) Applicant: FUJI XEROX CO., LTD., Tokyo (JP)

(72) Inventor: Yasuhiro Uehara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/013,249

(22) Filed: Feb. 2, 2016

(30) Foreign Application Priority Data

Aug. 5, 2015 (JP) ..... 2015-154756

(51) Int. Cl.
*G03G 15/20* (2006.01)

(52) U.S. Cl.
CPC ..... *G03G 15/2007* (2013.01); *G03G 15/2053* (2013.01)

(58) Field of Classification Search
CPC ..... G03G 15/2007; G03G 15/2053; G03G 15/2064
USPC ..... 399/336, 328, 329; 347/156
See application file for complete search history.

(56) References Cited

U.S. PATENT DOCUMENTS 9,335,687 B1 * 5/2016 Miyahara ..... G03G 15/2053
2011/0064448 A1 * 3/2011 Watanabe ..... G03G 15/2007 399/336 X
2012/0231390 A1 * 9/2012 Uekawa ..... G03G 15/2007 430/124.1
2014/0241765 A1 * 8/2014 Kodera ..... G03G 15/2007 399/329
2014/0354744 A1 * 12/2014 Ohnishi ..... B41J 2/01 347/102
2015/0093170 A1 * 4/2015 Kodera ..... G03G 15/2007 399/336
2016/0026122 A1 * 1/2016 Matsubara ..... G03G 15/2007 399/336
2016/0077476 A1 * 3/2016 Kamiya ..... G03G 15/2053 399/336
2016/0077477 A1 * 3/2016 Hidaka ..... G03G 15/2053 399/336

FOREIGN PATENT DOCUMENTS

JP 2009-163065 A 7/2009
JP 2012-118206 A 6/2012
JP 2013-101298 A 5/2013
JP 2013-120330 A 6/2013
JP 2015-072352 A 4/2015

* cited by examiner

*Primary Examiner* — Sophia S Chen
(74) *Attorney, Agent, or Firm* — Oliff PLC

(57) ABSTRACT

Provided is a fixing device including a rotating body that comes into contact with a surface of a light-transmitting recording medium which holds a toner image obtained by developing with a developer liquid, and absorbs a carrier liquid on the recording medium and the toner image, the developer liquid including a toner and the carrier liquid and the surface holding the toner image, a light-transmitting pressure member that is in contact with the rotating body and forms a pressure contact area in which the recording medium is pushed on the rotating body and passes between the light-transmitting pressure member and the rotating body, and an irradiating unit that irradiates the toner image with a laser beam when the recoding medium is present in the pressure contact area after the laser beam is transmitted through a portion of the pressure member.

16 Claims, 8 Drawing Sheets

| | ENERGY ABSORPTION RATIO OF TONER LAYER | |
|---|---|---|
| | IRRADIATION WITH LASER BEAM FROM TONER IMAGE HOLDING SURFACE SIDE | IRRADIATION WITH LASER BEAM FROM TONER IMAGE NON-HOLDING SURFACE SIDE |
| FIRST LAYER (IMAGE HOLDING SURFACE SIDE) | 0.03 | 0.8 |
| SECOND LAYER | 0.16 | 0.16 |
| THIRD LAYER (TONER IMAGE SURFACE SIDE) | 0.8 | 0.03 |

FIXING DEVICE AND IMAGE FORMING APPARATUS

CROSS-REFERENCE TO RELATED APPLICATIONS

This application is based on and claims priority under 35 USC 119 from Japanese Patent Application No. 2015-154756 filed Aug. 5, 2015.

BACKGROUND

Technical Field

The present invention relates to a fixing device and an image forming apparatus.

SUMMARY

According to an aspect of the invention, there is provided a fixing device including:

a rotating body that comes into contact with a surface of a light-transmitting recording medium which holds a toner image obtained by developing with a developer liquid, and absorbs a carrier liquid on the recording medium and the toner image, the developer liquid including a toner and the carrier liquid and the surface holding the toner image;

a light-transmitting pressure member that is in contact with the rotating body and forms a pressure contact area in which the recording medium is pushed on the rotating body and passes between the light-transmitting pressure member and the rotating body; and an irradiating unit that irradiates the toner image with a laser beam when the recoding medium is present in the pressure contact area after the laser beam is transmitted through a portion of the pressure member.

BRIEF DESCRIPTION OF THE DRAWINGS

Exemplary embodiments of the present invention will be described in detail based on the following figures, wherein.

DETAILED DESCRIPTION

Hereinafter, forms for embodying the invention (referred to as "exemplary embodiments" below) will be described with reference to the accompanying drawings.

First Exemplary Embodiment

Figure 1:
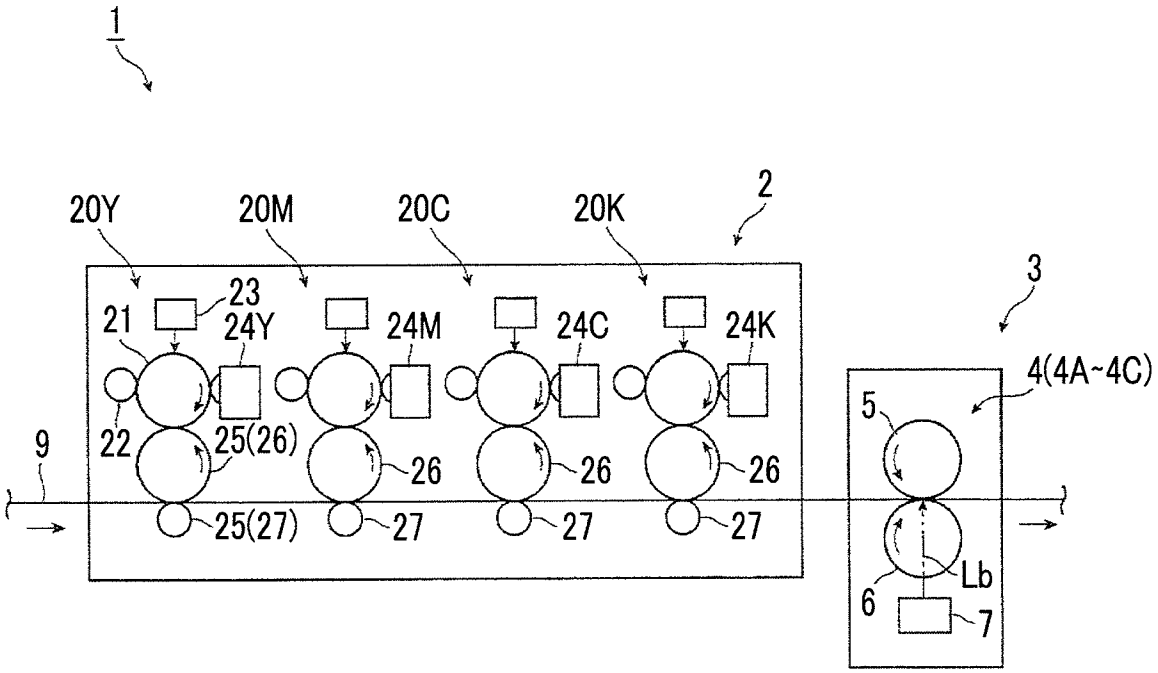
FIG. 1 is a conceptual diagram illustrating a configuration of an image forming apparatus using a fixing device according to a first exemplary embodiment.
Figure 2:
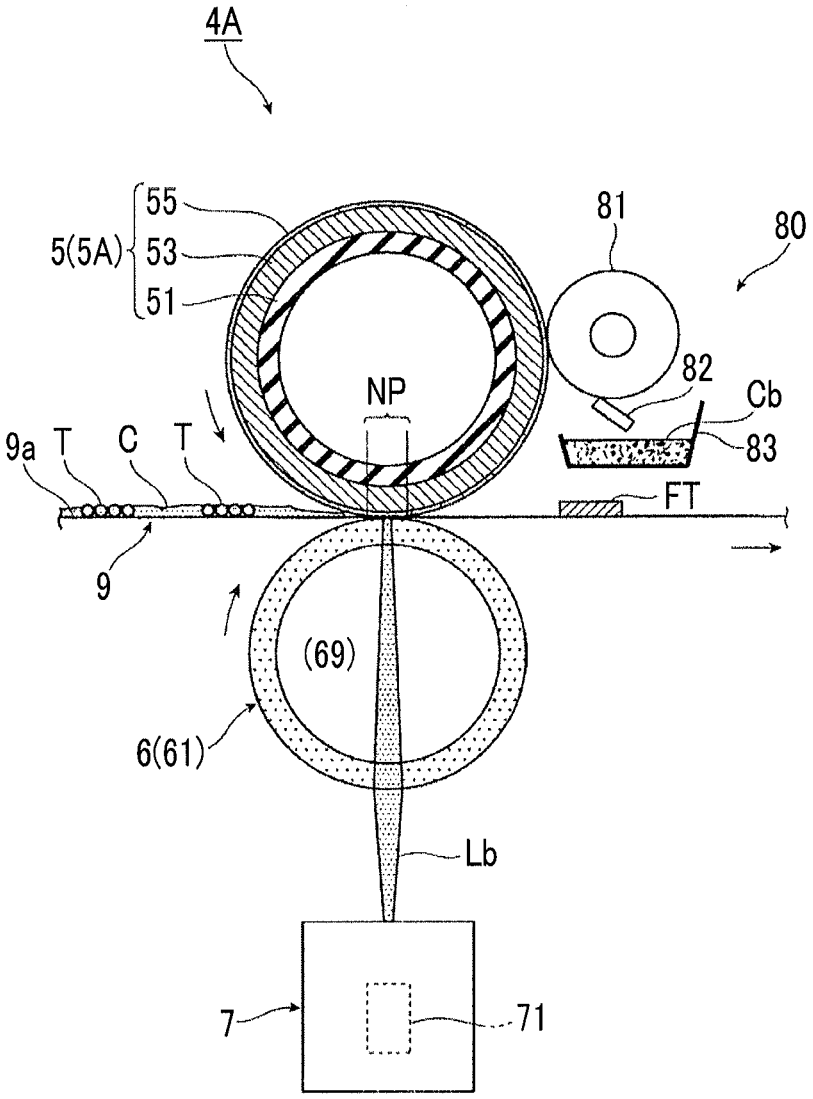
FIG. 2 is a conceptual diagram of a partial cross-section illustrating a configuration of the fixing device configuring a fixing section in the image forming apparatus in FIG. 1.

FIGS. 1 and 2 conceptually illustrate an image forming apparatus using a fixing device according to the first exemplary embodiment. FIG. 1 illustrates a configuration of the image forming apparatus and FIG. 2 illustrates a configuration of the fixing device.

An image forming apparatus 1 includes at least an image forming section 2 and a fixing section 3. The image forming section 2 forms a toner image and transfers the formed toner image to a light-transmitting recording medium 9. The toner image is formed of a developer liquid which includes a toner and a carrier liquid. The fixing section 3 fixes the toner image which has been transferred by the image forming section 2, to the recording medium 9.

Configuration of Image Forming Section

The image forming section 2 includes four image forming units 20Y, 20M, 20C, and 20K which respectively form toner images by using four color toners of yellow (Y), magenta (M), cyan (C), and black (K). Each of the four image forming units 20Y, 20M, 20C, and 20K similarly includes a photosensitive drum 21 as an example of a photosensitive body, a charging device 22, an exposure device 23, a developing device 24(Y, M, C, or K), a transfer device 25, and the like, except that the colors of the toners in the developer liquid of the four image forming units 20Y, 20M, 20C, and 20K are different from each other.

The photosensitive drum 21 is obtained by forming a photosensitive layer on a cylindrical or columnar conductive base which has been grounded. The photosensitive drum 21 is provided in a direction indicated by an arrow, so as to perform rotational driving. The charging device 22 charges an outer circumferential surface portion of the photosensitive drum 21 which is used as an image forming area, so as to have a required potential, and this charging device 22 is a contact type or anon-contact type. The exposure device 23 exposes the charged image forming area of the photosensitive drum 21 based on image information, so as to form an electrostatic latent image.

The developing device 24(Y, M, C, K) is a developing device using a liquid developing method. The developing device 24(Y, M, C, K) develops an electrostatic latent image on the photosensitive drum 21 with a developer liquid which includes the toner of the color corresponding to the color component, and thereby forming a toner image. The developer liquid is supplied to a developing area which faces the photosensitive drum 21, through a developing roll.

The developer liquid is a developer in a liquid state. In the developer liquid, toner powder is dispersed in the carrier liquid which is an electrically-insulating liquid. A material which is obtained by mixing a binding resin with a pigment or a dye for coloring is normally used as the toner. The material is configured by powder (fine particles) having an average particle size of from 0.1 μm to 5 μm, for example. As the binding resin, for example, a thermoplastic resin such as a polystyrene resin, a styrene acrylic resin, an acrylic resin, and a polyester resin is used. An infrared absorbing agent and the like, if necessary, is added to the toner. The infrared absorbing agent is used for absorbing a desired amount (of energy) of the laser beam. As the carrier liquid, for example, paraffinic oil, ether oil, silicone oil, and the like are used. A non-volatile liquid is used as the carrier liquid, but a volatile liquid may be used. The developer liquid is made in such a manner that the carrier liquid is mixed with the toner so that a weight ratio of the toner to the entirety of the developer is, for example, substantially from 5% to 30%. The viscosity of the developer liquid desirably has a value in a range of from 0.1 mPa·s to 1,000 Pa·s at 25° C. Particularly, if the viscosity is greater than 1,000 Pa·s, handling of the developer liquid such as agitation or transportation (liquid transportation) is difficult, and a burden of a device used for supplying a uniform developer liquid is increased.

The transfer device 25 finally transfers a toner image formed on the photosensitive drum 21 to the recording medium 9. The transfer device 25 in the first exemplary embodiment includes an intermediate transfer roll 26 and a final transfer roll 27. The intermediate transfer roll 26 is an example of an intermediate transfer body to which a toner image on the photosensitive drum 21 is primarily transferred and which transports the transferred toner image. The final transfer roll 27 transfers the toner image which has been transferred to the intermediate transfer roll 26, to the recording medium 9. The intermediate transfer roll 26 is provided so as to be in contact with the photosensitive drum 21 at a transfer position thereof and to be rotationally driven in a direction indicated by an arrow. The final transfer roll 27 is provided so as to be in contact with the intermediate transfer roll 26 at a transfer position thereof and to be rotationally driven. A primary transfer voltage is applied between the intermediate transfer roll 26 and the photosensitive drum 21. The primary transfer voltage is applied for transferring the toner image on the photosensitive drum 21 to the intermediate transfer roll 26 by using an electrostatic action. A secondary transfer voltage is applied between the final transfer roll 27 and the intermediate transfer roll 26. The secondary transfer voltage is applied for transferring the toner image on the intermediate transfer roll 26 to the recording medium 9 by using the electrostatic action.

As the light-transmitting recording medium 9, for example, a continuous transparent film is used. Light-transmitting properties mean that a medium at least has properties which allow a laser beam to travel therethrough. Transparency means colorless or colored transparency which exhibits the light-transmitting properties. The light-transmitting properties and transparency have a meaning similar to each other in the following descriptions. For example, the transparent film is sent and supplied toward the image forming section 2 from a supplying unit (not illustrated) which sends a recording medium. The transparent film passes through the image forming section 2 and the fixing section 3 in this order and then is recovered in a state of being wound and the like, by a recovery unit (not illustrated).

As the transparent film, for example, a film formed from polyethylene terephthalate (PET), oriented polypropylene (OPP), oriented nylon (ONY) and the like. A PET film is a film obtained by bi-axially stretching a polyethylene terephthalate material. The PET film is excellent in thermal resistance, dimensional stability, transparency, and machinability. An OPP film is a film obtained by bi-axially stretching a polypropylene material. The OPP film is excellent in transparency and damp-proof properties. The OPP film is used as a base material of a laminate film, for example. The OPP film is used in a wide range of fields, for example, a food industry. A ONY film is a film obtained by bi-axially stretching nylon 6. The ONY film is strong in pinhole, impact, wear, and the like, and is excellent in thermal resistance, cold resistance, barrier characteristics, and the like. The ONY film is generally used as a film material for food, a heavy bag, and industrial miscellaneous goods.

Such an image forming section 2 forms a toner image developed with the developer liquid, in the following manner and transfers the formed toner image to the light-transmitting recording medium 9.

If it is time to perform an image forming operation, in each of the image forming units 20(Y, M, C, and K) of the image forming section 2, the image forming area on the outer circumferential surface of the photosensitive drum 21 which starts rotating is charged by the charging device 22, so as to have a required potential. Then, the charged image forming area of the photosensitive drum 21 is irradiated with light corresponding to an image signal of the color component, from the exposure device 23. Thus, an electrostatic latent image corresponding to the color component is formed. The electrostatic latent image of the color component formed on the photosensitive drum 21 is developed with the supplied developer liquid when the electrostatic latent image of the color component passes through the corresponding developing device 24(Y, M, C, or K). Thus, a toner image of any color of the four colors (Y, M, C, and K) is formed on the photosensitive drum 21.

The toner image formed on the photosensitive drum 21 is transferred to the intermediate transfer roll 26 in the transfer device 25 and then is transported to the transfer position of the intermediate transfer roll 26, which faces the final transfer roll 27, by the intermediate transfer roll 26. The light-transmitting recording medium 9 is consecutively supplied into a space between the intermediate transfer roll 26 and the final transfer roll 27 in the transfer device 25. Thus, toner images which have respectively been transferred to the intermediate transfer rolls 26 are sequentially transferred to the light-transmitting recording medium 9 by a transfer action of the final transfer roll 27. The light-transmitting recording medium 9 to which toner images (T) are respectively transferred by the image forming units 20 (Y, M, C, and K) is moved so as to be transported toward the fixing section 3 for the next process.

In the image forming section 2 employing this liquid developing method, when a toner image is transferred to the intermediate transfer roll 26 from the photosensitive drum 21 in each of the image forming units 20, a portion of the carrier liquid in the developer liquid on the photosensitive drum 21 is transferred to the intermediate transfer roll 26. In addition, when a toner image is transferred to the recording medium 9 from the intermediate transfer roll 26, a portion of the carrier liquid in the developer liquid on the intermediate transfer roll 26 is also transferred to a recording medium 9. If the transparent film is used as the recording medium 9, the carrier liquid transferred to the recording medium 9 is not infiltrated to the recording medium 9. If a non-volatile film is used as the recording medium 9, reduction or elimination of the carrier liquid by volatilization does not occur.

In the image forming section 2, a drum cleaning device (not illustrated) removes the developer liquid remaining after a toner image on the photosensitive drum 21 is transferred, in each of the image forming units 20. A roll cleaning device (not illustrated) removes the developer liquid remaining after a toner image on the intermediate transfer roll 26 is transferred, in the transfer device 25.

Configuration of Fixing Section

The fixing section 3 includes a fixing device 4A which includes the following configuration.

As illustrated in FIGS. 1 and 2, the fixing device 4A includes a rotating body 5, a light-transmitting pressure member 6, and an irradiating unit 7. The rotating body 5 comes into contact with a surface 9*a* of the light-transmitting recording medium 9 which holds a toner image T developed in the image forming section 2 with a developer liquid, and absorbs the carrier liquid C on the recording medium 9 and the toner image T. The developer liquid includes a toner and a carrier liquid C. On the surface 9*a* of the light-transmitting recording medium 9, the toner image T is held. The light-transmitting pressure member 6 is in contact with the rotating body 5 and forms a pressure contact area NP in which the recording medium 9 is pushed on the rotating body 5 and passes between the light-transmitting pressure member and the rotating body. The irradiating unit 7 irradiates the toner image T with a laser beam Lb transmitted to the recording medium 9 when the laser beam Lb is transmitted through a portion of the pressure member 6 and then reaches a pressure contact area (nip) NP. The toner image T is an image which is not fixed. For convenience, FIG. 1 illustrates a form in which the fixing section 3 is individual from the image forming section 2. However, the fixing section 3 may be configured integrally with the image forming section 2.

The rotating body 5 is a structural object which absorbs as much of the carrier liquid C on the recording medium 9 and the toner image T, as possible. As the rotating body 5, for example, an absorption roll 5A is used. The absorption roll 5A includes a roll base member 51, an elastic absorption layer 53 provided on an outer circumferential surface of the roll base member 51, and an outermost layer 55 provided on an outer circumferential surface of the elastic absorption layer 53.

The rotating body 5 is provided so as to be rotatable, and is formed so as to receive power from a rotational driving device (not illustrated) and to drive rotationally in a direction required for moving and passing of the recording medium 9.

As the roll base member 51, for example, a cylindrical base member which is formed of a material such as metal is used. The elastic absorption layer 53 may absorb the carrier liquid and has elasticity. Elasticity preferably has an extent that the absorption layer 53 is elastically deformed and may form the pressure contact area NP when the absorption layer 53 is subjected to press contact on the pressure member 6. For example, the elastic absorption layer 53 is formed of a porous elastic material which has interconnection bubbles. The interconnection bubbles are interconnected bubbles which have characteristics of enabling rapid absorption and holding of the carrier liquid C by a capillary phenomenon and the like. For example, the outermost layer 55 is formed of a porous film material (stretched porous film and the like formed from a fluororesin and the like) which has air permeability and release properties from a toner.

As illustrated in FIG. 2, a recovery device 80 is provided on the rotating body 5 formed from the absorption roll 5A. The recovery device 80 recovers the carrier liquid C absorbed by the rotating body 5 (generally elastic absorption layer 53 of the absorption roll 5A).

As the recovery device 80, for example, an adsorption type device is used. The adsorption type device includes a recovery roll 81, a removing member 82, and an accommodating vessel 83. The recovery roll 81 is rotationally driven in a state of being in contact with the outer circumferential surface of the rotating body 5, and the recovery roll 81 adsorbs and recovers the carrier liquid C held by the rotating body 5. The removing member 82 is in contact with an outer circumferential surface of the recovery roll 81 and scrapes a recovery carrier liquid Cb which adheres to the outer circumferential surface thereof. The accommodating vessel 83 accommodates the recovery carrier liquid Cb scraped by the removing member 82.

The pressure member 6 is formed by a light-transmitting member which may form the pressure contact area NP in which the recording medium 9 is pushed on the rotating body 5 and passes between the pressure member 6 and the rotating body 5. The pressure contact area NP is formed as an area of which the width dimension (passing distance) has a value of from about 5 mm to 15 mm in a direction in which the recording medium 9 passes through the area, for example.

As such a pressure member 6, for example, a transparent rotating body 61 is used. As the transparent rotating body 61, a cylindrical transparent roll formed of a material such as quartz glass is applied. The transparent rotating body 61 is used so as to function as a condensing member that condenses the laser beam emitted from the irradiating unit 7, in the pressure contact area NP. Thus, conditions for the transparent rotating body 61, for example, the diameter, the thickness, and the like thereof are set to obtain a required condensing action. In order to adjust the refractive index and the like of the rotating body, for example, a cylindrical internal space of the transparent rotating body 61 may be enclosed with a transparent liquid 69 such as water or oil. The transparent liquid 69 is used as much as an amount of causing the internal space to be full, for example.

The pressure member 6 formed from the transparent rotating body 61 is provided so as to be rotatable. The pressure member 6 is provided in a state of being elastically pressed by a pressure mechanism (not illustrated). Thus, in the state, the pressure member 6 is in contact with the outer circumferential surface of the absorption roll 5A corresponding to the rotating body 5 which drives rotationally, by required pressure.

The irradiating unit 7 may transmit a laser beam Lb to the recording medium 9 in the pressure contact area NP after the laser beam Lb is transmitted through a portion of the pressure member 6, and then may irradiate the toner image T with the laser beam Lb. As the irradiating unit 7, a device configured by a laser beam source 71, a necessary optical component, and the like is used. The laser beam source 71 generates (emits) the laser beam Lb having a required emission wavelength (for example, 700 nm to 1,000 nm). Plural laser beam sources 71 are used and are disposed in a state where necessary adjustment may be applied, such that the laser beam Lb being in a consecutive state (line-shape) may be applied in a longitudinal direction of the pressure contact area NP (direction which is substantially perpendicular to the direction in which the recording medium 9 passes, or rotation axial direction of the rotating body 5).

The irradiating unit 7 is, for example, disposed at a position which is on the outside of the pressure member 6 formed from the transparent rotating body 61. This position is on an opposite side of the rotating body 5 with the pressure member 6 interposed between the irradiating unit 7 and the rotating body 5. Thus, the irradiating unit 7 at this time performs irradiation with the laser beam Lb, and thus the laser beam Lb generated by the laser beam source 71 is transmitted through a portion of the transparent rotating body 61 and then reaches the pressure contact area NP. Accordingly, the laser beam Lb emitted from the irradiating unit 7 is transmitted to the cylindrical roll (or wall) of the cylindrical transparent rotating body 61 twice and is refracted. Then, the laser beam Lb is applied in a state of being condensed in the pressure contact area NP.

For example, the control unit (not illustrated) controls the irradiating unit 7 to set an irradiation operation with the laser beam Lb to be performed only when a portion of the recording medium 9 which holds the toner image T to be fixed is present in the pressure contact area NP and passes through the pressure contact area NP. In this case, for example, prediction information and the like is used for a period of time from when the toner image T is introduced into the pressure contact area NP until the toner image T passes through the pressure contact area NP. The prediction information is obtained by presuming a period of time taken from a start point of time or an end point of time at which a toner image is transferred to the recording medium 9 in the image forming section 2, until the toner image reaches and passes through the pressure contact area NP.

Figure 3:
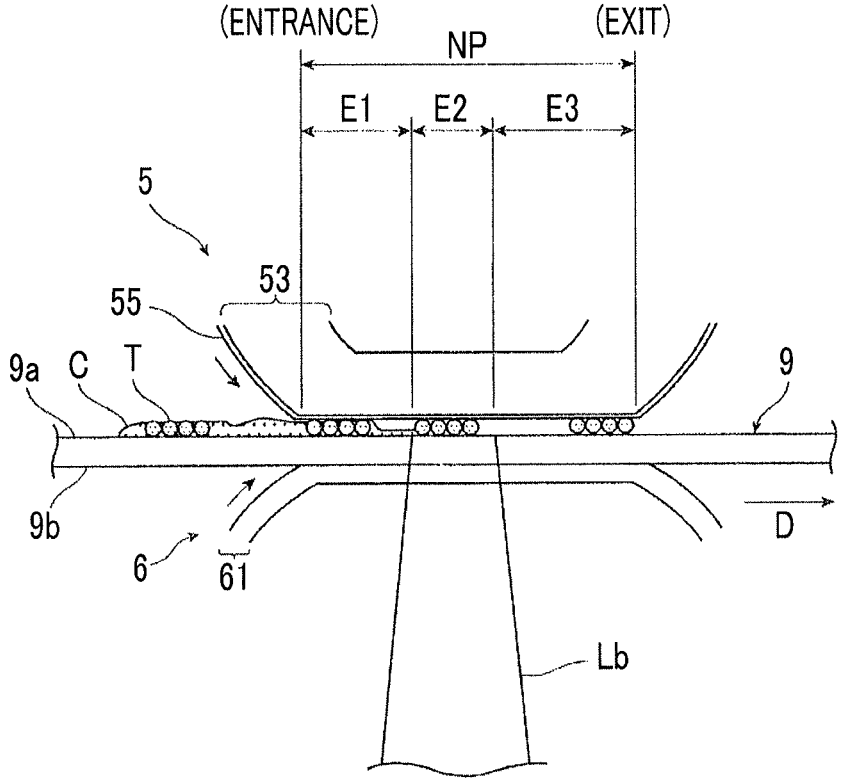
FIG. 3 is an enlarged diagram of a main portion (pressure contact area and surrounding portion thereof) in the fixing device in FIG. 2.

As illustrated in FIG. 3, the irradiating unit 7 is formed so as to cause an irradiation area (E2) to be in an area which is the substantially center portion of the pressure contact area NP in a direction Din which the recording medium 9 passes through the pressure contact area NP. In the irradiation area (E2), the laser beam Lb is condensed and applied.

Thus, the irradiating unit 7 is formed so as to cause a non-irradiation area (E1) to be present in the pressure contact area NP. The non-irradiation area (E1) is on an inlet side of the pressure contact area NP between the irradiation area (E2) of the laser beam Lb and the inlet, and is not irradiated with the laser beam Lb. In addition, the irradiating unit 7 is formed so as to cause a non-irradiation area (E3) to be present in the pressure contact area NP. The non-irradiation area (E3) is on an outlet side of the pressure contact area NP between the irradiation area (E2) of the laser beam Lb and the outlet, and is not irradiated with the laser beam Lb. Among these areas, the non-irradiation area (E1) on the inlet side is used as a liquid absorption area in which the rotating body 5 starts absorption of the carrier liquid C, as will be described later. The non-irradiation area (E3) on the outlet is used as a cooling area. The irradiation area (E2) of a laser beam is irradiated with the laser beam and thus the toner of the toner image T in the irradiation area (E2) becomes molten. In the cooling area, the molten toner is cooled.

When a dimension of the pressure contact area NP in the direction D in which the recording medium passes through the pressure contact area NP is set to be about from 5 mm to 15 mm, for example, the same dimension of the irradiation area (E2) is set to be about 0.2±0.1 mm. The width dimension (distance from the inlet to the irradiation area) of the non-irradiation area (E1) on the inlet side is set to be about from 3 mm to 10 mm. The same dimension (distance from the irradiation area to the outlet) of the non-irradiation area (E3) on the outlet side is set to be about from 2 mm to 12 mm.

Operation of Fixing Section

Fixation of the fixing section 3 (fixing device 4A) is performed as follows.

As illustrated in FIGS. 1, 2, and the like, in the fixing section 3, the rotating body 5(5A) in the fixing device 4A drives rotationally and the pressure member 6(61) in the fixing device 4A is rotationally driven while the pressure member 6(61) is in contact with the rotating body 5(5A) and forms the pressure contact area NP. The light-transmitting recording medium 9 which holds the toner image T having been transferred by the image forming section 2 is introduced into the pressure contact area NP in the fixing device 4A, and thus the fixation of the fixing section 3 is started. At this time, if the recording medium 9 is introduced into the pressure contact area NP, the recording medium 9 is transported so as to pass through the pressure contact area NP in a state of being interposed between the rotating body 5 (5A) and the pressure member 6 (61).

First, regarding the recording medium 9 which has been introduced into the pressure contact area NP, in the pressure contact area NP, the surface (image holding surface) 9*a* which holds the toner image T comes into contact with the absorption roll 5A which is the rotating body 5, and is pushed to the absorption roll 5A by pressing of the transparent rotating body 61 which is the pressure member 6 come into contact with an image non-holding surface 9*b* on an opposite side of the image holding surface 9*a*. As described above, the carrier liquid C of the developer liquid on the image holding surface 9*a* side is present in the recording medium 9 when being introduced into the pressure contact area NP and in the toner image T.

Thus, in the pressure contact area NP, the absorption roll 5A of the rotating body 5 starts absorption of the carrier liquid C on the image holding surface 9*a* of the recording medium 9, in the non-irradiation area (E1) on the inlet side.

At this time, in the absorption roll 5A, the carrier liquid C penetrates the outermost layer 55 and is absorbed in the elastic absorption layer 53. Since the elastic absorption layer 53 of the absorption roll 5A at this time has elasticity, the elastic absorption layer 53 is elastically deformed in accordance with an unevenness of the image holding surface 9*a*, which is present due to the toner image T of the recording medium 9. Thus, adhesion to the image holding surface 9*a* is improved and excellent absorption performance for the carrier liquid C is expressed. In the absorption roll 5A, the recovery device 80 recovers the carrier liquid C which has been absorbed by the elastic absorption layer 53 and thus ability to absorb the carrier liquid C is restored. The carrier liquid C is continuously absorbed by the absorption roll 5A of the rotating body 5 during a period of time when the recording medium 9 is present in the pressure contact area NP.

For example, when a medium (film, resin coating material, and the like) which has properties of not absorbing a carrier liquid or properties of absorption of the carrier liquid being difficult is applied as the recording medium 9, or when a non-volatile liquid is applied as the carrier liquid C, the absorption of the carrier liquid C in the non-irradiation area (E1) on the inlet side is particularly useful in that occurrence of fixation failure by the presence of a carrier liquid may be prevented in advance.

If the recording medium 9 reaches the irradiation area (E2) which is at the substantially center portion of the pressure contact area NP, the laser beam Lb emitted from the irradiating unit 7 is transmitted through a portion of the transparent rotating body 61 which is the pressure member 6, and then is transmitted through a transparent film which is the recording medium 9. Then, the transmitted laser beam Lb is applied toward the toner image T. At this time, the laser beam Lb travels such that the laser beam Lb is incident from the image non-holding surface 9*b* of the recording medium 9 and reaches the toner image T after the laser beam Lb is transmitted through a portion (two locations overlapping an optical path of the laser beam or a transparent liquid 69) of the transparent rotating body 61 which is the pressure member 6, and the laser beam Lb is condensed.

Thus, the toner forming a portion of the toner image T, which is irradiated with the laser beam Lb becomes molten starting from an interface side at which the toner is in contact with the recording medium 9, in the pressure contact area NP, and this toner starts adhering to the transparent film of the recording medium 9 while receiving a pressing action in the pressure contact area NP.

Finally, when the recording medium 9 passes through the non-irradiation area (E3) on the outlet side of the pressure contact area NP, the toner of the toner image T, which has been irradiated with the laser beam Lb and has become molten in the irradiation area (E2) ahead of the non-irradiation area (E3), passes through the non-irradiation area (E3) without irradiation with the laser beam Lb. Thus, natural cooling of the toner which has become molten is started.

Thus, since solidification of the toner image T by natural cooling is started, the toner image T is fixed to the transparent film which is the recording medium 9. The reference sign FT in FIG. 2 indicates a toner image after being fixed to the recording medium 9.

Regarding the above-described fixation by the fixing section 3, since the absorption (removal) of the carrier liquid is performed substantially simultaneously with melting of the toner image T by irradiation with the laser beam from the recording medium 9 side in the pressure contact area NP of the fixing device 4A, the toner image T developed with the developer liquid may be fixed to the light-transmitting recording medium 9 with high efficiency.

Accordingly, in the fixation by the fixing section 3, for example, it is not necessary that a process (device) of removing the carrier liquid before the toner image becomes molten (fixed) by irradiation with a laser beam be separately provided. In addition, it is not necessary that a process (device) of performing temporary fixing, which is used for preventing distortion of the toner image, before the removal of the carrier liquid is provided so as to be further added. Since it is not necessary that a carrier liquid removal unit or a temporary fixing unit is provided (that is, a configuration in which one fixing device includes a removal unit of a carrier liquid and a fixing unit by laser irradiation is made), the fixing device 4A may have a simple configuration.

Particularly, in the fixing device 4A of the fixing section 3, the pressure contact area NP is partitioned into three areas (that is, the non-irradiation area (E1) on the inlet side, the irradiation area (E2) of a laser beam, and the non-irradiation area (E3) on the outlet side) toward a downstream side in the direction D in which the recording medium 9 passes through the pressure contact area NP (FIG. 3).

Thus, firstly, the rotating body 5 absorbs the carrier liquid on the recording medium 9, in the non-irradiation area (E1) on the inlet side. Subsequently, the toner image on the recording medium 9 having a reduced carrier liquid becomes molten (heated) by irradiation with a laser beam in the irradiation area (E2) of a laser beam. Accordingly, the toner image T instantly becomes molten by being irradiated with a laser beam in a state where the carrier liquid is reduced. In addition, the toner image T adheres to the recording medium 9 in a state where a small amount of the carrier liquid is interposed between the toner image T and the recording medium 9. Since the toner becomes molten by irradiation with a laser beam, and the removal of the carrier liquid is started before the molten toner flows, the carrier liquid may be efficiently absorbed (removed).

At this point, for example, when a rotating body in which absorption of the carrier liquid is not possible is used as the rotating body 5 in the fixing device 4A, the following inconvenience occurs. That is, since the carrier liquid on the recording medium 9 to the rotating body (also including the recording medium 9) is not absorbed when the recording medium 9 is introduced into the pressure contact area NP, the carrier liquid is pushed back to the inlet side of the pressure contact area NP. As a result, a toner forming a not-fixed toner image T is moved so as to be pushed back along with the above carrier liquid, and thus image distortion occurs.

Then, the toner image T which has become molten by irradiation with a laser beam is naturally cooled in the non-irradiation area (E3) on the outlet side, in a state of being in the pressure contact area NP. Thus, fixing of the toner image T to the recording medium 9 is accelerated along with suppression of the occurrence of image distortion. Solidification is started by reliably performing cooling, and thus separation from the rotating body 5 is easily performed.

On the contrary, when the non-irradiation area (E3) on the outlet side in the pressure contact area NP is not provided in the fixing device 4A, the toner image T is not naturally cooled. Thus, acceleration of fixing of the toner image T and improvement of detachability from the rotating body 5 which are described above are not obtained.

Since the laser beam Lb is transmitted to the image non-holding surface (back surface) 9*b* of the recording medium 9 and a not-fixed toner image T which has been held on the light-transmitting recording medium 9 is irradiated with the laser beam Lb in the fixing device 4A, there are the following advantages.

First, since the toner becomes molten starting from the toner (portion) at the interface side being in contact with the recording medium 9, and thus adhesive force to the recording medium 9 occurs directly, fixing is performed with high efficiency in comparison to, for example, a case where irradiation with the laser beam Lb is performed from the surface side (image holding surface 9*a* side) of the toner image T.

Since the toner (portion) of the toner image T at the interface side with the absorption roll 5A which is the rotating body 5, in the pressure contact area NP becomes molten later than the toner (portion) at the interface side with the recording medium 9 and the temperature of the former toner is in a state of being relatively low, even when the former toner comes into contact with the porous outermost layer 55 of the absorption roll 5A in the pressure contact area NP, a portion of the toner forming the toner image T may not be cut out and may not be moved to the absorption roll 5A side, or the toner image may not be distorted, in comparison to, for example, a case where the laser beam Lb is applied from the surface side (image holding surface 9*a* side) of the toner image T.

Since variance occurs on the toner image T during the above period of time of being molten and the toner image T receives the pressure action in the pressure contact area NP, the carrier liquid C which is present in the toner image T (gap between toner particles) extrudes to the absorption roll 5A side through a gap (void) between not-molten toners at the interface side which is in contact with the absorption roll 5A. Finally, the carrier liquid C is absorbed by the absorption roll 5A. For this reason, as in a case of fixation which is performed until the carrier liquid C is present in the toner image T, occurrence of fixation failure (for example, situation in which adhesive force of the toner to the recording medium 9 is insufficiently obtained by the carrier liquid between the toner image T and the recording medium 9) or image defects (for example, situation in which color reproducibility, density, glossiness are not obtained) is suppressed.

Comparison Test

A comparison test will be described below. The comparison test is performed for confirming a merit of performing irradiation with the laser beam Lb by transmitting the laser beam Lb to a not-fixed toner image T which has been held on the recording medium 9, from the image non-holding surface (back surface) 9*b* of the recording medium 9.

Figures 4, 5:
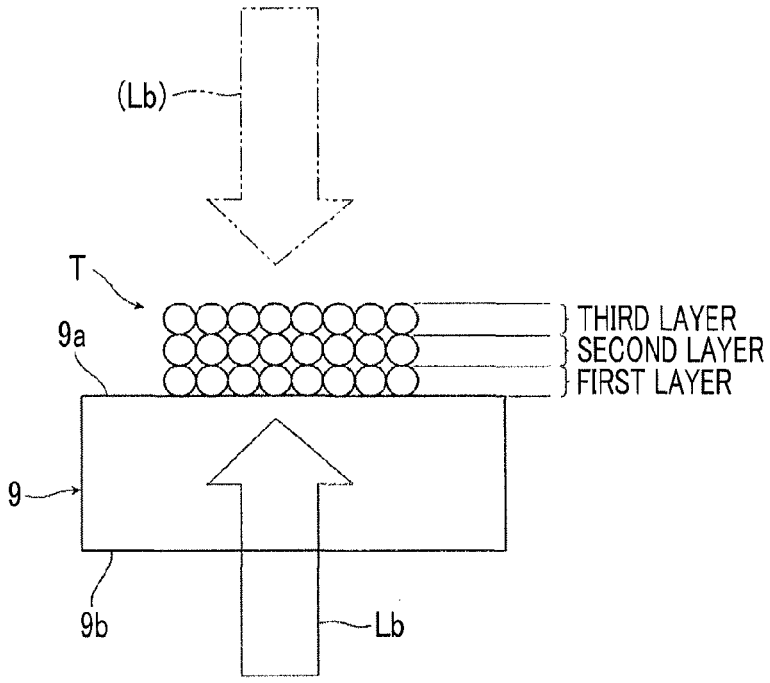
FIG. 4 is a conceptual diagram illustrating details of a comparison test.
FIG. 5 is a table illustrating results of the comparison test.

As illustrated in FIG. 4, the comparison test is performs as follows. When toner layers of cyan (C), magenta (M), and yellow (Y) are transferred onto the light-transmitting recording medium 9 in a state where the three toner layers are stacked in this order from down and fixing is performed by irradiation with the same laser beam, a ratio of energy which is absorbed by the three toner layer and by using irradiation with a laser beam is measured in a case where irradiation with the laser beam Lb is performed from the image holding surface 9*a* side (third layer) of the recording medium 9, and a case where the irradiation with the laser beam Lb is performed from the image non-holding surface 9*b* side (first layer) of the recording medium 9.

At this time, all of the toners forming the toner layer of the corresponding color use a toner which is formed of a polyester resin and has an average particle size of about 6 μm. An infrared absorbing agent is added to each of the toner so that the absorption amount of a laser beam is 80% when a single-layer toner is used. As the recording medium 9, a transparent resin film which is formed from an OPP film and has a thickness of about 0.02 mm is used. As the laser beam Lb, a beam having conditions that an emission wavelength is 900 nm and an irradiation width is 0.15 mm is used in irradiation. An energy absorption ratio of each of the toner layers is obtained as follows. Energy of light which is transmitted to an image sample when the image sample is irradiated with the laser beam Lb is measured. The image sample is obtained by forming and fixing the toner layer of each of the colors on the OPP film.

FIG. 5 illustrates results of the comparison test. From the results, it is found that the energy absorption amount of the toner (portion) at the interface side with the recording medium 9 is large in a case where irradiation with the laser beam Lb is performed from the image non-holding surface 9*b* (first layer) side of the recording medium 9, in comparison to a case where irradiation with the laser beam Lb is performed from the image holding surface 9*a* (third layer) side of the recording medium 9.

This means that when fixing is performed by irradiation with the laser beam Lb of the same energy, the toner (portion) at the interface side with the recording medium 9 is melted well in the case where the laser beam Lb is performed from the image non-holding surface 9*b* (first layer) side of the recording medium 9. In addition, this means that when the same fixedness is obtained, irradiation is completed with the laser beam of relatively small energy in the case where irradiation with the laser beam Lb is performed from the image non-holding surface 9*b* (first layer) side of the recording medium 9. According to the test of the inventors, the result that the energy of the laser beam Lb may be reduced by about 30% in the case where irradiation is performed from the image non-holding surface 9*b* (first layer) side is obtained.

Second Exemplary Embodiment

Figure 6:
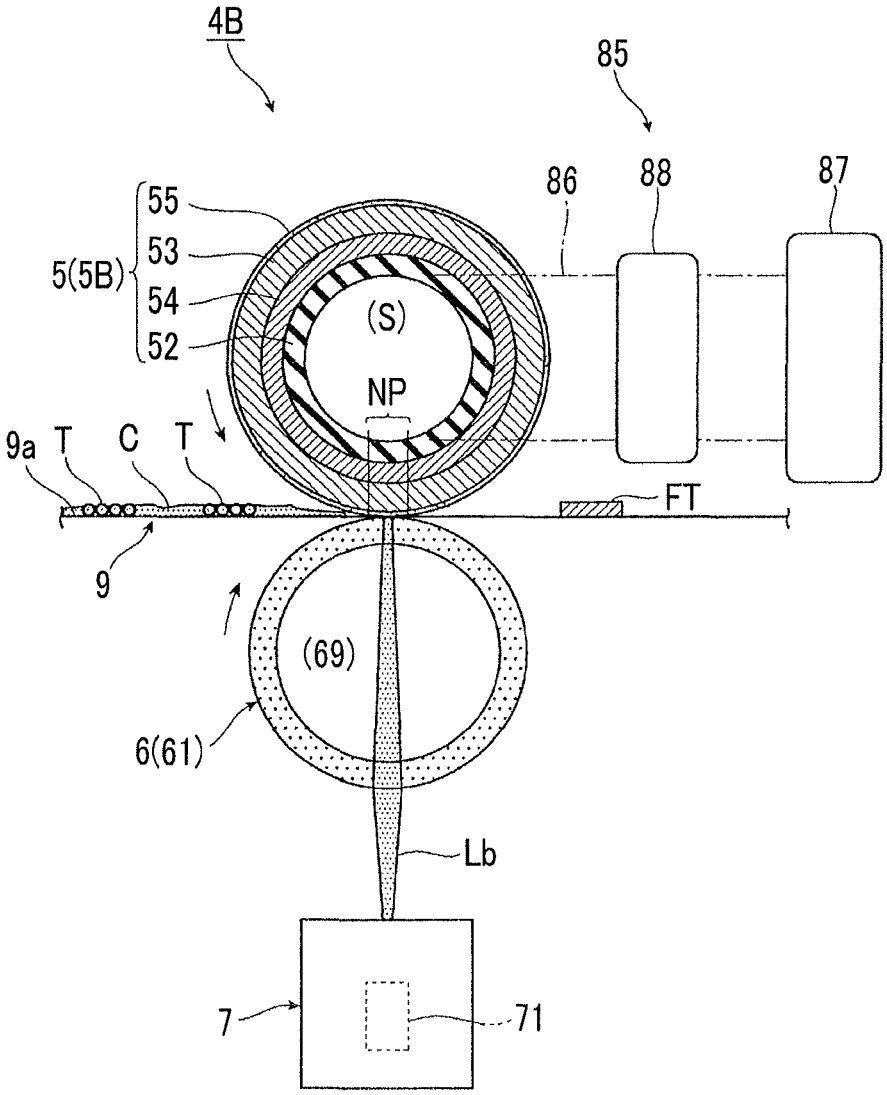
FIG. 6 is a conceptual diagram of a partial cross-section illustrating a configuration of a fixing device according to a second exemplary embodiment.
Figure 7:
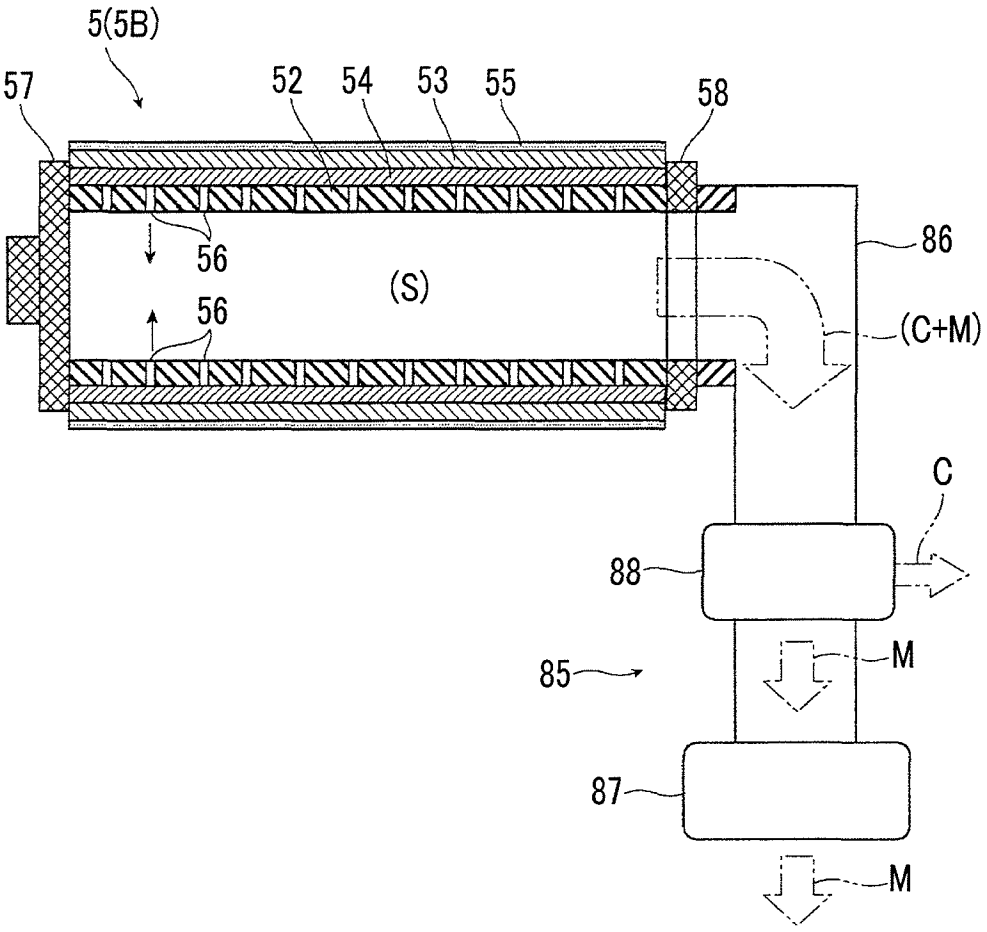
FIG. 7 is a diagram of another partial cross-section illustrating the configuration of the fixing device in FIG. 6.

FIGS. 6 and 7 conceptually illustrate a fixing device 4E configuring the fixing section 3 according to the second exemplary embodiment. FIG. 6 illustrates a configuration of the fixing device 4B. FIG. 7 illustrates a rotating body and a recovery device in the fixing device 4B in FIG. 6. Particularly, FIG. 7 illustrates a state where the rotating body is cut off along a rotation axis of the rotating body.

The fixing device 4B according to the second exemplary embodiment has the same configuration as that of the fixing device 4A according to the first exemplary embodiment except that the rotating body 5 is changed to an absorption roll 5B which has a different configuration, and the recovery device is changed to a recovery device 85 which has a different configuration. For this reason, in descriptions relating to the second exemplary embodiment, components the same as those in the fixing device 4A according to the first exemplary embodiment are denoted by the same reference signs, and the descriptions thereof will be omitted if unnecessary (this point is the same as in exemplary embodiments subsequent to the second exemplary embodiment).

As illustrated in FIG. 6, similarly to that of the fixing device 4A according to the first exemplary embodiment, the basic configuration of the fixing device 4B includes the rotating body 5, the light-transmitting pressure member 6, and the irradiating unit 7. The rotating body 5 comes into contact with a surface of the light-transmitting recording medium 9 which holds a toner image T developed with a developer liquid, and absorbs the carrier liquid C on the recording medium 9 and the toner image T. The light-transmitting pressure member 6 is in contact with the rotating body 5 and forms a pressure contact area NP in which the recording medium 9 is pushed on the rotating body 5 and passes between the light-transmitting pressure member and the rotating body. The irradiating unit 7 irradiates the toner image T with a laser beam Lb transmitted to the recording medium 9 when the laser beam Lb is transmitted through a portion of the pressure member 6 and then reaches a pressure contact area NP.

As the rotating body 5, for example, the absorption roll 5B is used. The absorption roll 5B includes a perforated roll base member 52, an absorption support layer 54 provided on an outer circumferential surface of the roll base member 52, the elastic absorption layer 53 provided on an outer circumferential surface of the absorption support layer 54, and the outermost layer 55 provided on an outer circumferential surface of the elastic absorption layer 53.

Among these components, the perforated roll base member 52 is, for example, a cylindrical base member formed of a material such as metal. As the perforated roll base member 52, a member in which ventilation holes 56 penetrating an internal space S thereof are provided on an outer circumferential surface thereof so as to be disposed at a substantially uniform interval is used. A terminal member 57 is attached to an end portion of the perforated roll base member 52 and thus the internal spaces is closed. An opening terminal member 58 is provided at another end portion. In the opening terminal member 58, a through hole which is linked to the internal space S is formed.

The absorption support layer 54 has air permeability, and is used for preventing deformation of the elastic absorption layer 53 so as to be crushed. The deformation occurs by receiving an influence of absorption force when an absorption type recovery device 85 (which will be described later) performs absorption. As such an absorption support layer 54, for example, a sintered body obtained by sintering synthetic resin powder of polyethylene or the like is applied.

As the recovery device 85, an absorption type device is used. The absorption type device includes a ventilation pipe 86, a suction device 87, and a separation device 88. The ventilation pipe 86 is connected and extended to the opening terminal member 58 of the perforated roll base member 52 in the absorption roll 5B which is the rotating body 5. The suction device 87 is connected to a termination portion of the ventilation pipe 86 and performs suction so as to apply absorption force to the internal space S of the absorption roll 5B. The separation device 88 is provided in the middle of the ventilation pipe 86, and separates the carrier liquid C from an air M containing the carrier liquid C which is sucked from the absorption roll 5B. As the suction device 87, for example, a vacuum pump and the like are applied. As the separation device 88, a device which includes a filter enabling separation of the carrier liquid, a device which includes an air-liquid separation filter enabling separation of oil mist if necessary, and the like are applied.

The fixing section 3 (fixing device 4B) performs fixation substantially similarly to fixation of the above-described fixing section 3 (fixing device 4A) according to the first exemplary embodiment except that a method of absorbing the carrier liquid is different.

Particularly, in the fixing device 4B, the absorption roll 5B of the rotating body 5 absorbs the carrier liquid C on the image holding surface 9*a* of the recording medium 9 which has been introduced into the pressure contact area NP, over the entirety of the pressure contact area NP by using the non-irradiation area (E1) on the inlet side as a start.

At this time, in the absorption roll 5B, the absorption force based on an absorption action of the suction device 87 in the recovery device 85 passes through the perforated roll base member 52, the absorption support layer 54, the elastic absorption layer 53, and the outermost layer 55 in this order and is applied to the image holding surface 9*a*.

The carrier liquid C which is present on the image holding surface 9*a* and in the toner image T is absorbed to the elastic absorption layer 53 through the outermost layer 55 in the absorption roll 5B by the capillary phenomenon and the like. However, in addition to this, as illustrated in FIG. 7, the absorption roll 5B receives the absorption force by the recovery device 85, and thus the carrier liquid C is absorbed and collected to the internal space S of the roll base member 52 from the ventilation holes 56 of the perforated roll base member 52 through the outermost layer 55, the elastic absorption layer 53, and the absorption support layer 54. After that, the absorbed carrier liquid C is transported to the separation device 88 through the ventilation pipe 86 and then is recovered in a state of being separated from the air M by the separation device 88.

As the fixing device 4B, a device in which the absorption support layer 54 is provided as the absorption roll 5B between the perforated roll base member 52 and the elastic absorption layer 53 is employed. Thus, partial influence on a portion of the elastic absorption layer 53 corresponding to the ventilation holes 56 by concentrating the absorption force of the recovery device 85 at the plural ventilation holes 56 in the perforated roll base member 52 when the carrier liquid is recovered is alleviated by interposition of the absorption support layer 54 which is harder than the elastic absorption layer 53. Thus, deformation of the portion of the elastic absorption layer 53 or the surrounding portion thereof is difficult. As a result, in the fixing device 4B, occurrence of a situation in which interconnected bubbles at the portion of the elastic absorption layer 53 or the surrounding portion thereof are pushed and thus an action of absorbing the carrier liquid is insufficiently expressed is suppressed. In addition, absorption performance of the elastic absorption layer 53 is ensured in the entirety of the elastic absorption layer 53 with substantially uniformity and stability.

Third Exemplary Embodiment

Figure 8:
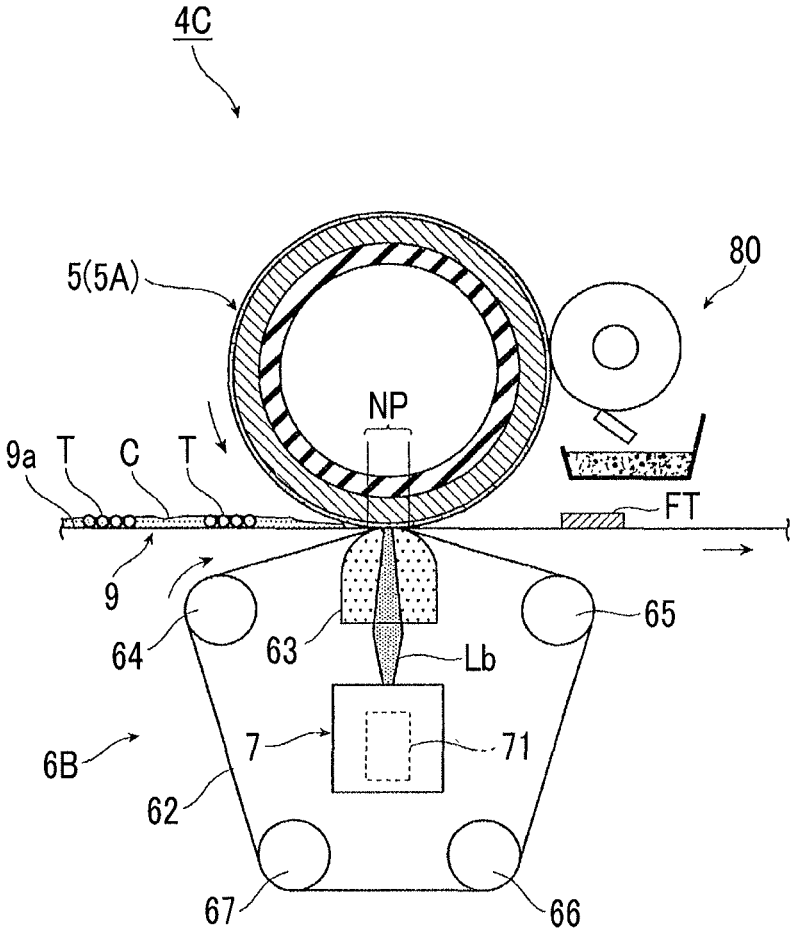
FIG. 8 is a conceptual diagram of a partial cross-section illustrating a configuration of a fixing device according to a third exemplary embodiment.

FIG. 8 conceptually illustrates a fixing device 4C configuring the fixing section 3 according to the third exemplary embodiment.

The fixing device 4C according to the third exemplary embodiment has the same configuration as that of the fixing device 4A according to the first exemplary embodiment except that the pressure member 6 is changed to a pressure member 6B which has a different configuration.

That is, the pressure member 6B in the fixing device 4C includes a light-transmitting belt 62, a pressure lens (pad) 63, and plural support rolls 64 to 67. The pressure lens (pad) 63 functions as a pressure and condensing member which pushes the belt 62 on the rotating body 5 (absorption roll 5A) so as to form the pressure contact area NP and causes the laser beam Lb from the irradiating unit 7 to perform transmission so as to be condensed in the pressure contact area NP. The plural support rolls 64 to 67 cause the belt 62 to be wound across the plural support rolls 64 to 67 along with the pressure lens 63 such that the belt is rotatable, and the plural support rolls 64 to 67 supports the belt along with the pressure lens 63.

Among these components, as the belt 62, for example, a transparent belt which is formed of a transparent material such as polyimide is used. The belt 62 has a configuration in which the belt 62 is supported by the plural support rolls 64 to 67 so as to be rotatable and the belt 62 is rotationally driven by rotation force of the rotating body 5 or a configuration in which any one of the plural support rolls 64 to 67 is used as one driving roll and rotationally drives. As the pressure lens 63, for example, an object which is molded by using a transparent material such as transparent glass and transparent polycarbonate and is molded so as to have a required shape is used. The required shape of the object is used in order to obtain both of the pressure action and a light condensation action. A section of the pressure lens 63 at a portion on a side on which the pressure lens 63 is in contact with the rotating body 5 has a semicircular shape or a curved shape. The pressure lens 63 is held by a holding member (not illustrated) and is supported in a state of being pushed on the rotating body 5 with required pressure by a pressure mechanism (not illustrated).

The irradiating unit 7 is disposed so as to be, for example, in a space on an inner side of the belt 62 (the inside of the belt 62) by employing of the pressure member 6B. In this case, the irradiating unit 7 is configured so as to transmit the laser beam Lb to the pressure lens 63 and the belt 62 in this order and then to perform irradiation in a state where the laser beam Lb is condensed in the pressure contact area NP.

The fixing section 3 (fixing device 4C) performs fixation substantially similarly to fixation of the above-described fixing section 3 (fixing device 4A) according to the first exemplary embodiment except that a structural change occurs by employing the pressure member 6B.

Particularly, in the fixing device 4C, the transparent belt 62 is pushed on the pressure lens 63 from an inner circumferential surface of the transparent belt 62 and thus the pressure contact area NP is formed on the rotating body 5(5A) which rotationally drives. The laser beam Lb emitted from the irradiating unit 7 is transmitted through the pressure lens 63 and a portion of the belt 62 and is condensed in the irradiation area (E2) of the pressure contact area NP. The laser beam Lb is transmitted to the recording medium 9 in the pressure contact area NP and the toner image T is irradiated with the laser beam Lb.

In the third exemplary embodiment, the irradiating unit 7 may be disposed at a position on an outer side of the belt 62 (on the outside of the belt 62) in the fixing device 4C. In the fixing device 4C, the absorption roll 5A and the recovery device 80 may be respectively changed to the absorption roll 5B and the recovery device 85 in the second exemplary embodiment, for example.

Fourth Exemplary Embodiment

Figure 9:
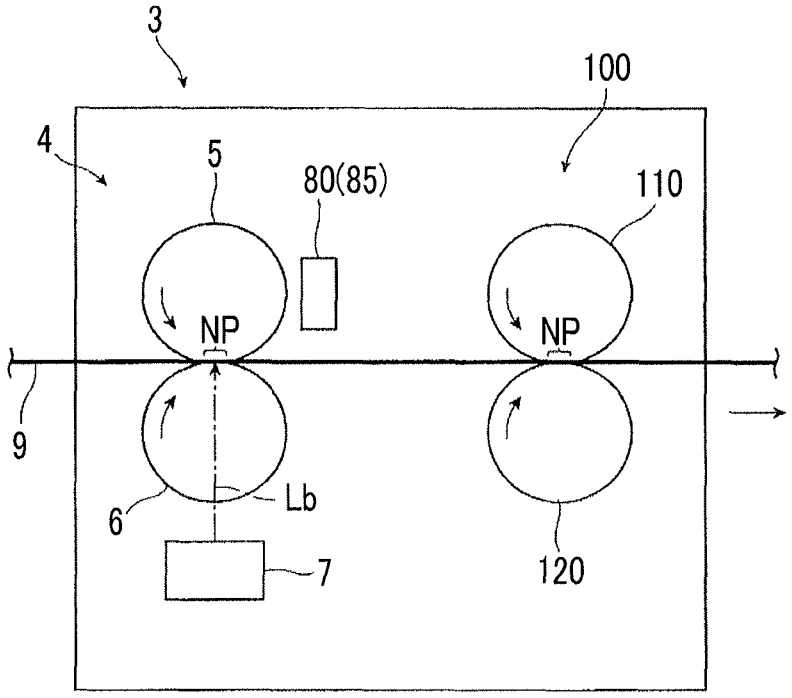
FIG. 9 is a conceptual diagram illustrating a configuration of a fixing section according to a fourth exemplary embodiment.

FIG. 9 conceptually illustrates the fixing section 3 according to the fourth exemplary embodiment.

The fixing section 3 according to the fourth exemplary embodiment includes a second fixing device 100 in addition to the (first) fixing device 4 which absorbs the carrier liquid and performs irradiation with a laser beam from the back surface side. The second fixing device 100 is provided at a position on a downstream side of the fixing device 4 in a transport direction of the recording medium 9.

The second fixing device 100 fixes a toner image FT which has been fixed by the first fixing device 4, to the recording medium 9 again. As the second fixing device 100, for example, a device which includes a rotating body 110 for heating and a rotating body 120 for pressing is used. The rotating body 110 for heating heats the toner image FT and has a roll shape, a belt shape, and the like. The rotating body 120 for pressing is in contact with the rotating body 110 for heating so as to form the pressure contact area NP and has a roll shape, a belt shape, and the like.

In such a fixing section 3, since fixation by the first fixing device 4 and fixation of the second fixing device 100 are performed, the toner image T obtained by developing with the developer liquid may be more reliably fixed onto the light-transmitting recording medium 9.

Since the first fixing device 4 absorbs and removes almost the entirety of the carrier liquid on the recording medium 9 and the like in, the second fixing device 100 does not require a function of absorbing the carrier liquid. When the first fixing device 4 functions as a fixing device which performs temporary fixing, the second fixing device 100 may function as a fixing device which performs final fixing (formal fixing).

Other Exemplary Embodiments

In the first to fourth exemplary embodiments, configuration examples in which both of the non-irradiation area (E1) on the inlet side and the non-irradiation area (E3) on the outlet side are provided as the pressure contact area NP in the fixing device 4 are described. However, a configuration in which any one of the two non-irradiation areas is not provided may be made. In this case, the above-described actions and advantages of the omitted non-irradiation area are not obtained.

As the rotating body 5 in the fixing device 4, an object having a belt shape may be applied. As the pressure member 6 in the fixing device 4, a member which is installed so as to be fixed may be applied as long as the member forms the pressure contact area NP through the recording medium 9 may be used.

In the first to fourth exemplary embodiments, a case where a continuous transparent film is applied as the light-transmitting recording medium 9 is exemplified. However, for example, a light-transmitting film or sheet which is cut out so as to have a required size and a required shape may be applied.

The image forming section 2 in the image forming apparatus 1 is not limited to a section having a configuration exemplified by the first exemplary embodiment and the like. The image forming section 2 may have any configuration as long as the image forming section may form the toner image T developed with the developer liquid and transfer the toner image T to the light-transmitting recording medium 9.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a rotating body that comes into contact with a surface of a light-transmitting recording medium which holds a toner image obtained by developing with a developer liquid, and absorbs a carrier liquid on the recording medium and the toner image, the developer liquid including a toner and the carrier liquid and the surface holding the toner image;

a light-transmitting pressure member that is in contact with the rotating body and forms a pressure contact area in which the recording medium is pushed on the rotating body and passes between the light-transmitting pressure member and the rotating body; and an irradiating unit that irradiates the toner image with a laser beam when the recoding medium is present in the pressure contact area after the laser beam is transmitted through a portion of the pressure member.

2. The fixing device according to claim 1, wherein in the irradiating unit, a first non-irradiation area which is not irradiated with a laser beam is present between an irradiation area irradiated with the laser beam, and an inlet of the pressure contact area in the pressure contact area.

3. The fixing device according to claim 2, wherein the irradiating unit is configured so as to cause a second non-irradiation area which is not irradiated with a laser beam to be present between the irradiation area irradiated with the laser beam, and an outlet of the pressure contact area in the pressure contact area.

4. The fixing device according to claim 3, wherein the rotating body includes an elastic absorption layer which absorbs the carrier liquid.

5. An image forming apparatus comprising:

an image forming section that forms a toner image by developing with a developer liquid which includes a toner and a carrier liquid, and transfers the toner image to a light-transmitting recording medium; and a fixing section that fixes the toner image transferred by the image forming section, onto the recording medium, wherein the fixing section includes at least the fixing device according to claim 4.

6. An image forming apparatus comprising:

an image forming section that forms a toner image by developing with a developer liquid which includes a toner and a carrier liquid, and transfers the toner image to a light-transmitting recording medium; and a fixing section that fixes the toner image transferred by the image forming section, onto the recording medium, wherein the fixing section includes at least the fixing device according to claim 3.

7. The fixing device according to claim 2, wherein the rotating body includes an elastic absorption layer which absorbs the carrier liquid.

8. An image forming apparatus comprising:

an image forming section that forms a toner image by developing with a developer liquid which includes a toner and a carrier liquid, and transfers the toner image to a light-transmitting recording medium; and a fixing section that fixes the toner image transferred by the image forming section, onto the recording medium, wherein the fixing section includes at least the fixing device according to claim 7.

9. An image forming apparatus comprising:

an image forming section that forms a toner image by developing with a developer liquid which includes a toner and a carrier liquid, and transfers the toner image to a light-transmitting recording medium; and a fixing section that fixes the toner image transferred by the image forming section, onto the recording medium, wherein the fixing section includes at least the fixing device according to claim 2.

10. The fixing device according to claim 1, wherein in the irradiating unit, a second non-irradiation area which is not irradiated with a laser beam is present between the irradiation area irradiated with the laser beam, and an outlet of the pressure contact area in the pressure contact area.

11. The fixing device according to claim 10, wherein the rotating body includes an elastic absorption layer which absorbs the carrier liquid.

12. An image forming apparatus comprising:

an image forming section that forms a toner image by developing with a developer liquid which includes a toner and a carrier liquid, and transfers the toner image to a light-transmitting recording medium; and a fixing section that fixes the toner image transferred by the image forming section, onto the recording medium, wherein the fixing section includes at least the fixing device according to claim 11.

13. An image forming apparatus comprising:

an image forming section that forms a toner image by developing with a developer liquid which includes a toner and a carrier liquid, and transfers the toner image to a light-transmitting recording medium; and a fixing section that fixes the toner image transferred by the image forming section, onto the recording medium, wherein the fixing section includes at least the fixing device according to claim 10.

14. The fixing device according to claim 1, wherein the rotating body includes an elastic absorption layer which absorbs the carrier liquid.

15. An image forming apparatus comprising:

an image forming section that forms a toner image by developing with a developer liquid which includes a toner and a carrier liquid, and transfers the toner image to a light-transmitting recording medium; and a fixing section that fixes the toner image transferred by the image forming section, onto the recording medium, wherein the fixing section includes at least the fixing device according to claim 14.

16. An image forming apparatus comprising:

an image forming section that forms a toner image by developing with a developer liquid which includes a toner and a carrier liquid, and transfers the toner image to a light-transmitting recording medium; and a fixing section that fixes the toner image transferred by the image forming section, onto the recording medium, wherein the fixing section includes at least the fixing device according to claim 1.

* * * * *